United States Patent [19]

Murphy

[11] Patent Number: 5,071,028

[45] Date of Patent: Dec. 10, 1991

[54] STORAGE DRUM WITH DRAIN CHANNEL

[76] Inventor: Donald M. Murphy, 2201 Lenora Rd., Loganville, Ga. 30249

[21] Appl. No.: 580,141

[22] Filed: Sep. 10, 1990

[51] Int. Cl.[5] ..... B65D 7/42

[52] U.S. Cl. ..... 220/601; 220/4.04; 220/4.05; 220/669

[58] Field of Search ..... 220/601, 608, 669, 5 R, 220/DIG. 1, 4.04, 4.05

[56] References Cited

U.S. PATENT DOCUMENTS

| | | | |
|---|---|---|---|
| 943,686 | 12/1909 | Kruse | 220/601 |
| 1,344,688 | 6/1920 | Griner . | |
| 1,658,251 | 2/1928 | Nord . | |
| 2,354,425 | 7/1944 | Kuhn | 220/601 X |
| 3,129,730 | 4/1964 | Simon | 220/608 X |
| 3,170,586 | 2/1965 | Bulgrin | 220/5 R |
| 3,985,257 | 10/1976 | Shaffer et al. | 220/669 |
| 4,245,685 | 1/1981 | Nemitz et al. | 220/608 X |
| 4,767,021 | 8/1988 | Pies | 220/5 R X |
| 4,779,771 | 10/1988 | Song | 222/456 |

OTHER PUBLICATIONS

Residual Quantity <0.10 litres, *The Pump Tube*, RE 88, Lutz, Wertheim.

*Primary Examiner*—Steven M. Pollard
*Attorney, Agent, or Firm*—Louis T. Isaf

[57] ABSTRACT

An improved drum draining apparatus is provided through forming a lowered sump in the bottom panel of the drum opposite the bunghole and forming a channel along the inside wall of the drum which connects the sump to the bunghole. When the drum is nearly empty, the remaining fluid inside the drum can be drained by tilting the drum from a vertical position over onto the side where the channel is located.

18 Claims, 1 Drawing Sheet

STORAGE DRUM WITH DRAIN CHANNEL

FIELD OF THE INVENTION

This invention relates generally to fluid storage containers and particularly to 55 gallon drums.

BACKGROUND OF THE INVENTION

Industrial chemicals are often stored in 55 gallon steel drums which are sealed entirely and accessible through a small bunghole in a lid at one end of the drum. The sides of the drum are usually corrugated in part, to strengthen the drum walls and provide rigidity. During use, a hose or pump is inserted into the drum through the bunghole, with the drum in a vertical position. Once the majority of the drum contents have been pumped out, the pump is removed and some of the remaining fluid in the drum can be poured out. Alternately, the drum can be fitted with a valve on the bunghole and then placed horizontally, relying primarily on the force of gravity for drainage.

Due to the configuration of the lip of the drum and the location of the bunghole, approximately 1.75 inches from the edge of the drum lid, it is nearly impossible to drain the drum entirely. When the drum is filled with acid or other hazardous liquids, careful draining of the drum contents is often skipped or at best performed hastily.

In fact, it is common to leave two or more liters of fluid inside the drum. The "empty" drum is, in many cases, taken to a land fill and crushed. When one multiplies this seemingly small volume by the huge numbers of drums which are dumped in U.S. land fills on a daily basis, one begins to realize the magnitude of the problem created by incomplete drainage. Proper draining of drums containing hazardous fluids, such as sulfuric acid, pesticides, and other chemicals before the drum arrives at a land fill would enormously decrease the amount of hazardous wastes that eventually end up loose in the environment.

Currently, people throughout the world are expressing a renewed interest in the issue of environmental safety. Corporations are even advertising how their policies reduce impact on the environment. Possible reasons why the 55 gallon drum has not been redesigned before to allow for more complete draining are that the size of the current drum is an industrial standard and that the current shape of the drum creates a very rigid container. Any redesign which changed the shape of the drum without reducing container strength would have widespread effects on how drums are shipped, stored and handled. An ideal solution would not change the outer drum dimensions, yet would provide for easy and near complete drum drainage.

SUMMARY OF THE INVENTION

The present invention provides a new drum configuration which does not change the outer dimensions nor the inner volume of the drum, but which allows for more complete draining of the drum contents. This is accomplished by shaping the bottom panel to slope downward into a lowered sump area. The lowered sump area is positioned below and opposite the bunghole, which is located near one side of the top panel. When the drum is used in a vertical position with a pump tube inserted down through the bunghole and into the sump area, almost all of the drum contents can be evacuated with the pump. Any fluid remaining inside the drum after the pump is removed will be accommodated by the volume of the sump.

A channel is attached to the interior of the drum between the sump area and the bunghole during manufacture. Tilting the drum over onto the side of the drum where the sump, channel and bunghole are located, will cause the majority of fluid remaining within the sump area to flow through the channel to the bunghole and out of the drum.

It is therefore an object of the present invention to provide an improved storage drum drainage apparatus which will not require changing the outer dimensions of the drum.

Another object of the present invention is to provide a improved storage drum drainage apparatus which will allow drainage of the drum contents so that no more than about 100 ml of fluid will remain inside a standard 55 gallon drum after draining.

Other objects, features and advantages of the present invention will become apparent upon reading and understanding this specification, taken in conjunction with the accompanying drawings.

DETAILED DESCRIPTION OF THE PREFERRED EMBODIMENT

Figure 5:
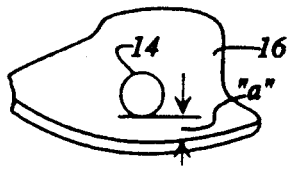
FIG. 5 is an isolated planer view, taken from inside the drum of FIG. 1 and looking at the top panel in the vicinity of the bunghole.
Figure 1:
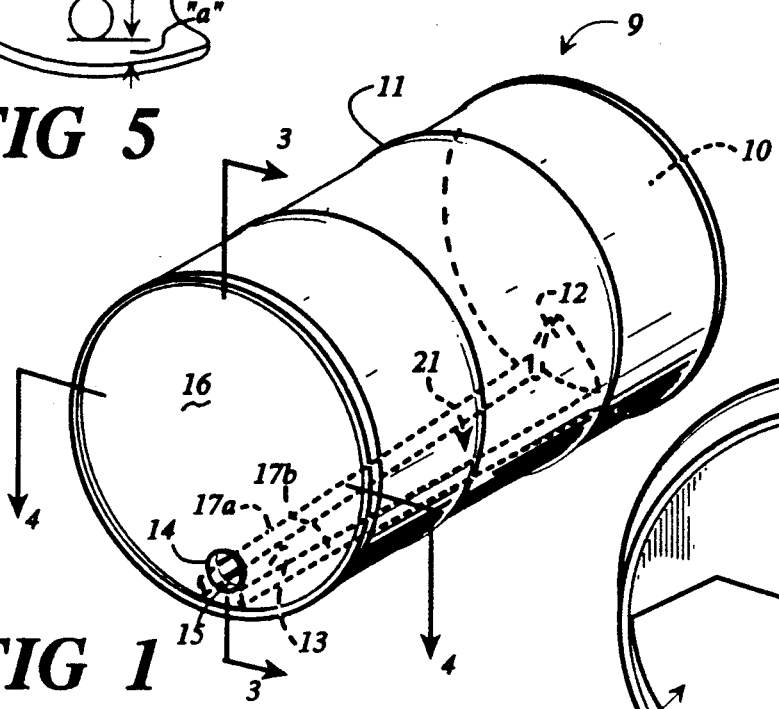
FIG. 1 is a three quarter cutaway view of the preferred embodiment of the present invention.
Figure 2:
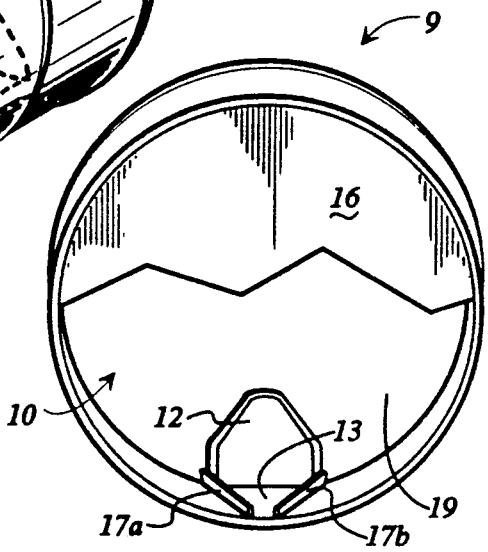
FIG. 2 is a view of the preferred embodiment of FIG. 1 with the top panel partially removed.

Referring now in greater detail to the drawings, in which like numerals indicate like components throughout the several views, FIGS. 1–4 show the preferred embodiment of a drum 9, in accordance with the present invention, as including an outer wall section 11, top panel 16 and bottom panel 10. A bunghole 14 provides access to the drum interior through the top panel 16 and is positioned at a distance "a" from the drum outer wall 11. The distance "a" is the shortest distance as measured from the inside diameter of the bunghole 14 to the inside diameter of the outer wall 11 (see FIGS. 3 and 5). The criticality of this measurement "a" as it relates to certain embodiments is given below.

Figure 3:
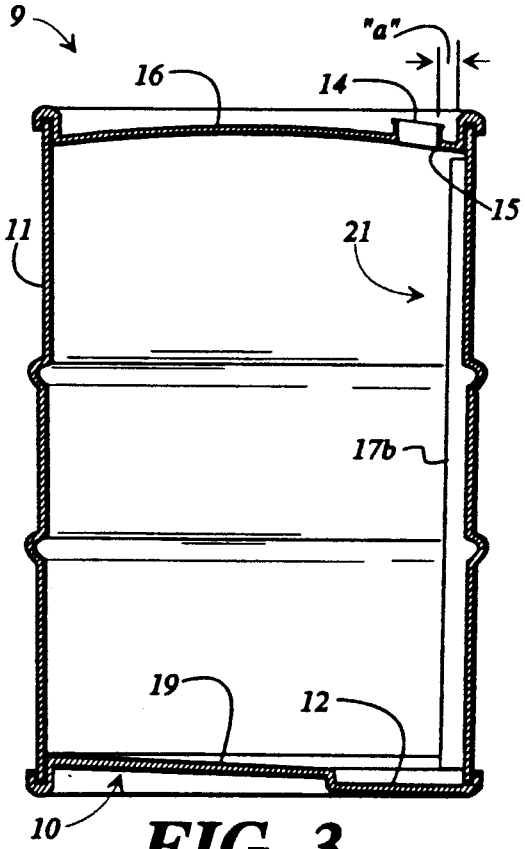
FIG. 3 is a sectional view of the drum embodiment of FIG. 1 taken along line 3—3.
Figure 4:
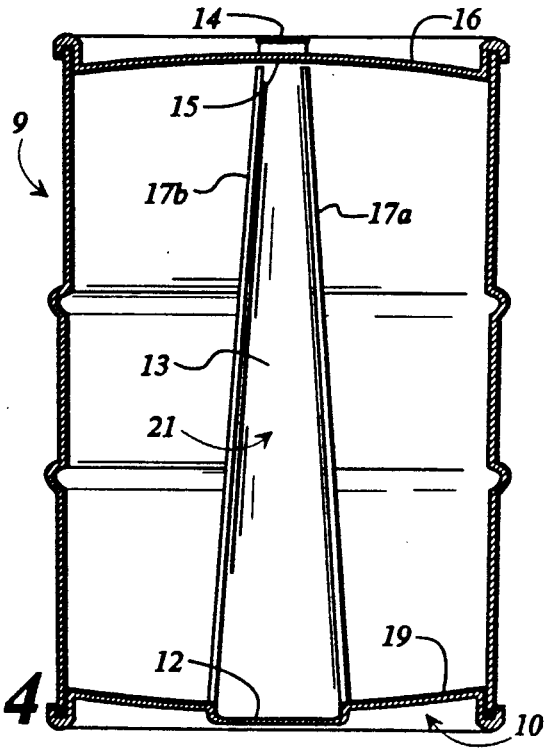
FIG. 4 is a sectional view of the drum embodiment of FIG. 1 taken along line 4—4.

The bottom panel 10 is formed with a pan section 19 and a sump 12. With the drum 9 in a vertical position (see FIG. 3) the sump 12 is seen as a pocket or depression in the bottom panel 10; and the pan section 19 slopes downward from all edges toward the sump 12, providing a type of spillway for directing fluid to the sump. The sump 12 is vertically aligned (as seen in FIG. 3) with the bunghole 14.

In the preferred embodiment, a channel 21 is formed inside the drum 9 along one segment of the drum outer wall 11 and is made up of a channel side panel 13 and two raised wall sections 17*a*, 17*b*. In the preferred embodiment the two raised wall sections 17*a*, 17*b* begin on either side of the sump 12 at the intersection of the outer wall 11 and the bottom panel 10 and extend up along the edges of the channel side panel 13 but do not actually intersect with the top panel 16. In the preferred embodiment, a gap 15 exists at the top end of raised wall sections 17*a*, 17*b*; although alternate, less preferred embodiments within the scope of the invention eliminate this gap 15 and include a channel which slopes up to and partially around the bunghole 14. The gap 15 allows any fluids outside the channel to escape around the raised wall sections and exit the drum through the bunghole 14 as the bottom 10 end of the drum is lifted from the horizontal position of FIG. 1.

In the preferred embodiment, the channel side panel 13 and the two raised wall sections 17*a*, 17*b* are formed from one piece of metal, with the channel side panel being formed from a curved piece of metal which matches the curvature of the outer wall section 11. During construction of the preferred embodiment the channel side panel 13 is inserted inside the outer wall section 11 before the top panel 16 and bottom panel 10 are attached. During attachment of the bottom 10 and top 16 panels the channel side panel 13 is crimped between the top panel and the outer wall section 11 and between the bottom panel and the outer wall section 11. This leaves a small space between the outer wall section 11 and channel side panel 13, but this space is, typically, small enough that no appreciable amount of fluid is caught here. In other embodiments the drum 9, including outer wall 11, top panel 16, bottom panel 10 and channel 21 are formed from molded plastic into one solid piece during manufacture. In still another embodiment, the raised wall sections 17*a*, 17*b* are each separately formed and attached to the inside of the outer wall 11, which inside of the outer wall serves as the "side panel" of the channel 21.

Operation. When a 55 gallon drum is used in a vertical position (see FIG. 3) with a pump (not shown), a pump tube (not shown) is inserted through bunghole 14 and extends down into the sump 12. The pump is able to evacuate most of the fluid from the drum with a pump tube in this position. However, for various reasons, some fluid will remain within the sump (directed by the sloping pan section 19) after the pump tube is removed: the pump tube only extends to within a certain distance from the drum bottom, or the contents of the pump tube drains back into the drum after the pump tube is pulled up above the level of the fluid. The first of these reasons will almost be eliminated because a given depth of fluid at the bottom of the sump 12 has a much smaller volume than the same depth spread over the bottom of the entire drum, which has a much greater area. In this case, the drum is tilted over to the right (as oriented in FIG. 3) so that fluid in the sump 12 flows out onto the channel side panel 13 between raised wall sections 17*a*, 17*b*. Once the drum reaches a horizontal orientation, most of the liquid will be inside the channel, and raising the bottom 10 of the drum will cause the majority of fluid in the channel to flow out of the drum through bunghole 14.

Whereas the present invention finds broad invention in the embodiments described above, there is certain, more specific invention attributed to the criticality of the bunghole 14 positioning, at least with respect to some embodiments of the present invention. A standard 55 gallon drum, made to American Standard Association, Inc. specifications, is made from 18 gage steel and has the standard dimensions of approximately: outer wall 11 having an inside diameter of approximately 22.5 inches; outer wall 11 having a height between 34.37 and 36 inches (measured at its outside, not within the inside storage cavity); and a bunghole inside diameter of approximately 2 inches. It is extremely difficult to drain much more than about 1500 ml of fluid out of a prior art drum by tilting the drum as described above, because the bunghole of a standard drum is located approximately 1.75 inches (distance "a") from the inside of the outer wall 11, and some fluid is trapped between the bunghole and the edge of the drum. The specific, preferred embodiment of the present invention, to be utilized in connection with the standard dimensioned, rolled steel, 55 gallon drum, orients the bunghole 14 at a distance "a" of 3/4 inch. It is understood that location of the bunghole 14 might be considered in most cases to be a matter of design choice. However, the position of the bunghole 14 in this stated, preferred embodiment for the 55 gallon rolled steel drum of the present invention, is deemed inventive as it constitutes a certain criticality achieved by inventive thought and development, whereby the structural integrity of the 55 gallon drum is maintained while allowing for evacuation of a maximum amount of fluid from the drum cavity.

Whereas the present invention has been described in detail with specific reference to particular embodiments thereof, it will be understood that variations and modifications may be effected within the spirit and scope of the present invention as hereinbefore described and as defined in the appended claims.

I claim:

1. In a storage drum of the type having a cylindrical outer wall section, a bottom panel attached to a first end of the outer wall section, a top panel attached to a second end of the outer wall section, and a bunghole in the top panel communicating between the drum exterior and the drum interior, the improvement comprising:

a sump formed in the bottom panel, said sump being aligned with the bunghole and adjacent to the drum outer wall; and channel means for guiding fluid from said sump to the bunghole as the drum in a vertical position is tipped into a horizontal position, said channel means comprising two raised wall sections positioned adjacent the interior of the drum outer wall, said raised wall sections being spaced apart from one another, each said raised wall section beginning next to said sump at the intersection of the outer wall and the bottom panel and extending up along the outer wall toward the bunghole.

2. The improvement of claim 1, wherein one of said raised wall sections begins on one side of said sump and the other of said raised wall sections begins on the opposite side of said sump.

3. The improvement of claim 1, wherein said raised wall sections are each separately formed and attached to the inside of the outer wall of the drum.

4. The improvement of claim 1, wherein said channel means further comprises a flat side panel mounted between said raised wall sections and between the top and bottom panels.

5. The improvement of claim 4, wherein said raised wall sections and said flat side panel of said channel means are formed as a single unit, separate from the outer wall, top panel and bottom panel of the drum and, whereby said single unit channel means is attached to the inside of the drum during manufacture.

6. The improvement of claim 1, wherein one of said raised wall sections begins on one side of said sump and the other of said raised wall sections begins on the opposite side of said sump.

7. The improvement of claim 1, wherein the drum, including outer wall section, top panel and bottom panel, and the sump and raised wall sections are formed as one, solid, molded piece during manufacture.

8. A storage drum comprising:

a cylindrical outer wall section;

a bottom panel attached to a first end of said outer wall section;

a top panel attached to a second end of said outer wall section;

a bunghole in said top panel communicating between the drum exterior and the drum interior, and a sump formed in the bottom panel, said sump being aligned with the bunghole and adjacent to the drum outer wall; and channel means for guiding fluid from said sump to the bunghole as the drum in a vertical position is tipped into a horizontal position, said channel means comprising two raised wall sections positioned adjacent the interior of said drum outer wall, said raised wall sections being spaced apart from one another, each said raised wall section beginning next to said sump at the intersection of said outer wall and said bottom panel and extending up along said outer wall toward said bunghole.

9. The storage drum of claim 8, wherein the outer wall section, the top panel, the bottom panel, the sump and the raised wall sections are formed as one, solid, molded piece during manufacture.

10. Storage drum of claim 8, wherein said raised wall sections are each separately formed and attached to the inside of said outer wall.

11. Storage drum of claim 8, wherein said channel means further comprises a flat side panel mounted between said raised wall sections and between the top and bottom panels.

12. Storage drum of claim 11, wherein said raised wall sections and said flat side panel of said channel means are formed as a single unit, separate from said outer wall, top panel and bottom panel of the drum and, wherein said single unit channel means is attached to the inside of the drum during manufacture.

13. A 55 gallon storage drum comprising:

a cylindrical outer wall section having an inside diameter in the range of 22 to 24 inches and having an outside height in the range of 34 to 36 inches;

a bottom panel attached to a first end of said outer wall section;

a top panel attached to a second end of said outer wall section;

a bunghole in said top panel, communicating between the drum exterior and the drum interior, and positioned between 0.5 inch and 1 inch from the inside surface of said outer wall section; and a sump formed in the bottom panel, said sump being aligned with the bunghole and adjacent to the drum outer wall; and channel means for guiding fluid from said sump to the bunghole as the drum in a vertical position is tipped into a horizontal position, said channel means comprising two raised wall sections positioned adjacent the interior of said drum outer wall, said raised wall sections being spaced apart from one another, each said raised wall section beginning next to said sump at the intersection of said outer wall and said bottom panel and extending up along said outer wall toward said bunghole.

14. 55 gallon storage drum of claim 13, wherein said bottom panel slopes gradually from the outer edge of said bottom panel, which intersects with said outer wall section, down toward said sump.

15. 55 gallon storage drum of claim 13, wherein said raised wall sections are each separately formed and attached to the inside of said outer wall.

16. 55 gallon storage drum of claim 13, wherein said channel means further comprises a flat side panel mounted between said raised wall sections and between the top and bottom panels.

17. 55 gallon storage drum of claim 16, wherein said raised wall sections and said flat side panel of said channel means are formed as a single unit, separate from said outer wall, top panel and bottom panel of the drum and, wherein said single unit channel means is attached to the inside of the drum during manufacture.

18. The improvement of claim 13, wherein one of said raised wall sections begins on one side of said sump and the other of said raised wall sections begins on the opposite side of said sump.

* * * * *